US005435929A

United States Patent [19]

Tada et al.

[11] Patent Number: 5,435,929

[45] Date of Patent: Jul. 25, 1995

[54] PERMEABLE MAGNETIC COMPOSITION AND MAGNETIC COMPONENT

[75] Inventors: Masashito Tada; Keiichiro Suzuki, both of Iwaki, Japan

[73] Assignee: Kureha Kagaku Kogyo Kabushiki Kaisha, Tokyo, Japan

[21] Appl. No.: 191,703

[22] Filed: Feb. 4, 1994

Related U.S. Application Data

[63] Continuation-in-part of Ser. No. 15,798, Feb. 10, 1993, abandoned.

[30] Foreign Application Priority Data

Feb. 28, 1992 [JP] Japan ..... 4-078679
Aug. 10, 1992 [JP] Japan ..... 4-234267

[51] Int. Cl.[6] ..... H01F 1/113

[52] U.S. Cl. ..... 252/62.54; 524/609; 524/423

[58] Field of Search ..... 252/62.54, 62.6, 62.62; 524/609, 423

[56] References Cited

U.S. PATENT DOCUMENTS 2,685,568 8/1954 Wilson ..... 252/62.6
4,543,382 9/1985 Tsuchida et al. ..... 252/62.54

FOREIGN PATENT DOCUMENTS 573068 3/1959 Canada ..... 252/62.6
2-22130 1/1990 Japan ..... 252/62.62

*Primary Examiner*—Mark L. Bell
*Assistant Examiner*—C. M. Bonner
*Attorney, Agent, or Firm*—Wenderoth, Lind & Ponack

[57] ABSTRACT

Magnetic components having a higher permeability than those obtained from Ni-Zn-based ferrite powder can be obtained by molding a composition comprising 5–30 wt. parts of polyarylene sulfide resin and 70–95 wt. parts (providing 100 wt. parts with the resin) of Ni-Zn-Cu-based ferrite powder. The Ni-Zn-Cu-based ferrite has a composition represented by the following formula (1):

$$Ni_aZn_bCu_cFe_2O_d,$$

wherein a, b, c and d are numbers satisfying $0.10 \leqq a \leqq 0.70$, $0.10 \leqq b \leqq 0.80$, $0.10 \leqq c \leqq 0.35$ and $3.97 \leqq d \leqq 4.20$.

10 Claims, 1 Drawing Sheet

PERMEABLE MAGNETIC COMPOSITION AND MAGNETIC COMPONENT

This application is a continuation-in-part of now abandoned application Ser. No. 08/015,798, filed Feb. 10, 1993, now abandoned.

FIELD OF THE INVENTION AND RELATED ART

The present invention relates to a polyarylene sulfide resin composition excellent in permeability and a magnetic component shaped therefrom.

Polyarylene sulfide resin is an engineering plastic having excellent heat resistance, chemical resistance and electrical insulating property and, because of such properties, has been recently used in a wide scope of industries of, e.g., electrical, electronics and automobiles.

Of these, a permeable magnetic composition containing a powdery soft magnetic material dispersed in a binder of polyarylene sulfide resin is being considered for use as various magnetic components, such as coils, inductors and filters, by taking advantage of small mold shrinkage characteristics in addition to the heat resistance, chemical resistance and the electrical insulation properties of the polyarylene sulfide. As the soft magnetic material, Ni-Zn-based ferrite is particularly suitable for use in circuit components for medium frequency or high frequency ranges.

Hitherto, it has been the practice to increase the content of the soft magnetic powder in the composition in order to obtain a molded product having a high permeability. However, it has been difficult to increase the permeability of a composition comprising Ni-Zn-based ferrite as the magnetic material and polyarylene sulfide as the binder by increasing the content of the Ni-Zn-based ferrite.

SUMMARY OF THE INVENTION

An object of the present invention is to provide a composition comprising polyarylene sulfide resin and a Ni-Zn-based ferrite having a high permeability which has not been realized by this type of composition.

Selection of a magnetic material having a higher permeability in its sintered state than the Ni-Zn-based ferrite for dispersion in a resin does not necessarily provide a resin composition having a higher permeability. As a result of our study, it has been discovered that a Ni-Zn-Cu-based ferrite of a specific composition as described below provides a composition having a high permeability when combined with polyarylene sulfide resin.

According to the present invention, there is provided a permeable magnetic composition, comprising 5–30 wt. parts of polyarylene sulfide resin and 70–95 wt. parts of Ni-Zn-Cu-based ferrite powder providing a total of 100 wt. parts together with the polyarylene sulfide resin, said Ni-Zn-Cu-based ferrite having a composition represented by the following formula (1):

$$Ni_aZn_bCu_cFe_2O_d,$$

wherein a, b, c and d are numbers satisfying $0.10 \leqq a \leqq 0.70$, $0.10 \leqq b \leqq 0.80$, $0.10 \leqq c \leqq 0.35$ and $3.97 \leqq d \leqq 4.20$.

These and other objects, features and advantages of the present invention will become more apparent upon a consideration of the following description of the preferred embodiments of the present invention taken in conjunction with the accompanying drawing.

DETAILED DESCRIPTION OF THE INVENTION

Figure 1:
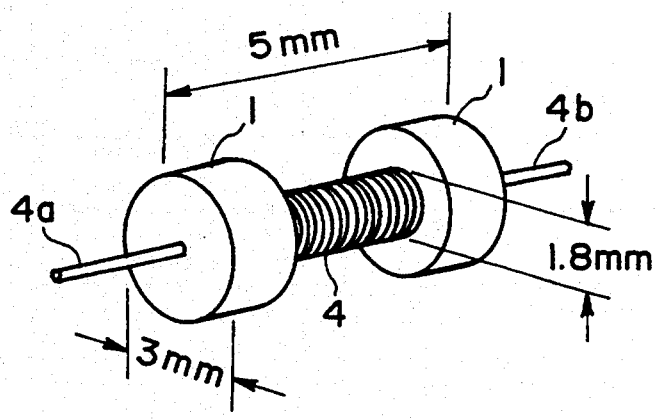
FIGS. 1 and 2 are a perspective view and a sectional view, respectively, of a coil and a core encapsulated in Examples 5 and 6.

In Ni-Zn based ferrite, it is well known that too much or too little Ni or Zn fails to provide a high permeability. This is also true in Ni-Zn-Cu based ferrite. More specifically, it is appropriate that the parameter a representing the nickel (Ni) content is in the range of 0.10–0.70, preferably 0.15–0.50, more preferably 0.17–0.30. It is appropriate that the parameter b representing the zinc (Zn) content is in the range of 0.10–0.80, preferably 0.40–0.75, more preferably 0.50–0.70.

Similarly as the parameters a and b, too large or too small a parameter c representing the copper (Cu) content fails to provide a high permeability and the required range therefor is rather narrower than a and b. More specifically, it is appropriate that the parameter c is in the range of 0.10–0.35, preferably 0.15–0.30, more preferably 0.17–0.25. Below 0.10 or in excess of 0.35, it is difficult to obtain the product obtained through, e.g., injection or compression molding with an increased permeability.

Further, in the formula (1), it is appropriate that the parameter d representing the oxygen content is in the range of 3.97–4.20, preferably 3.98–4.15, more preferably 3.99–4.10. Below 3.97 or in excess of 4.20, the resultant product obtained through, e.g., injection or compression molding, is caused to have a lower electrical insulating property, so that it becomes difficult to retain a high permeability in a high frequency region.

The Ni-Zn-Cu-based ferrite may generally be calcined at a temperature of 1000°–1350° C. for a period of 1–5 hours, preferably around 2 hours. The permeability of the Ni-Zn-Cu-based ferrite may be generally increased according to the progress of the calcination, i.e., at a higher calcination temperature. However, in excess of 1350° C., the Cu component is liable to be converted into $CuO_2$ rather than the desirable form of CuO and the Zn component can be partly lost by evaporation, thus being liable to somewhat lower the permeability of the resultant Ni-Zn-Cu-based ferrite.

The Ni-Zn-Cu-based ferrite may preferably be calcined to have a permeability which is at least 80% of its saturation permeability (i.e., the highest permeability obtained at the composition through a sufficient degree of calcination by calcination at a sufficiently high temperature of, e.g., 1300°–1350° C.). According to our study, the saturation permeability of the Ni-Zn-Cu-based ferrite used in the present invention is not particularly higher than that of a conventional Ni-Zn-based ferrite having a corresponding composition except for the omission of the Cu component but provides a magnetic composition having a higher permeability when mixed with polyarylene sulfide resin, knead and molded into such a magnetic composition, compared with the Ni-Zn-based ferrite of the corresponding composition. This is presumably because the Ni-Zn-Cu-based ferrite is more resistant to a high temperature and a high pressure during a molding, such as injection molding, thus causing a lower degree of decrease in saturation permeability in the molding, compared with the corresponding Ni-Zn-based ferrite.

The Ni-Zn-Cu-based ferrite powder used in the present invention may preferably have an average particle size (diameter) according to the light scattering method (as measured by using Model "LA-500" available from Horiba Seisakusho K. K.) in the range of 3–200 μm, more preferably 5–200 μm. If the average particle size is below 3 μm, the composition is caused to have an excessively high melt viscosity, and it becomes difficult to form a molded product having a satisfactory appearance. Further, a smaller particle size tends to provide a smaller permeability. If the ferrite powder has an average particle size in excess of 200 μm, it becomes difficult to form a small size product and is liable to promote the wearing of a mold surface.

The Ni-Zn-Cu-based ferrite powder can be surface-treated with a known surface treating agent, such as a silane coupling agent, a titanate coupling agent, an aluminum coupling agent, or a phosphorus-based coupling agent.

Herein, the polyarylene sulfide resin refers to a polymer comprising at least 50 wt. %, preferably at least 70 wt. %, more preferably at least 90 wt. %, of a recurring unit represented by —Ar-S—, wherein —Ar— denotes an arylene group.

It is particularly preferred to use a polyarylene sulfide having a substantially linear structure formed from a monomer (or monomer mixture) comprising a bi-functional monomer because of an excellent toughness. It is however possible to use a polyarylene-sulfide having a partially crosslinked structure or subjected to curing for increasing the melt viscosity as far as the mechanical properties are not impaired thereby.

A preferred example of the recurring unit —Ar-S— is a p-phenylene sulfide unit represented by

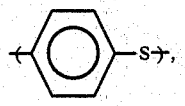

The polyarylene sulfide may be a homopolymer, a random copolymer or a block copolymer. The copolymer may preferably comprise at least 50 wt. %, particularly at least 60 wt. %, of the p-phenylene sulfide having the structure shown above and at most 50 wt. %, particularly at most 40 wt. %, of at least one of m-phenylene sulfide unit, diphenylene sulfide unit, tri-functional phenyl sulfide unit, naphthalene sulfide unit, phenyl ketone phenyl sulfide unit, phenyl sulfone unit, phenyl ether phenyl sulfide unit, phenyl sulfone phenyl sulfide unit, and phenyl ketone phenyl ketone sulfide unit respectively represented by the following structural formulae:

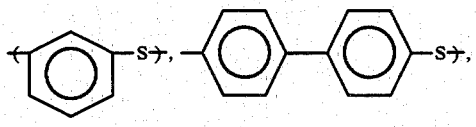

-continued

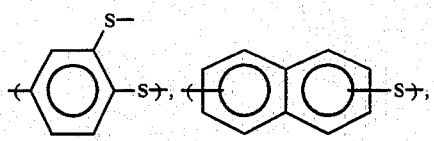

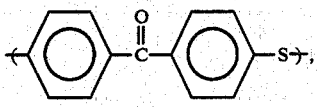

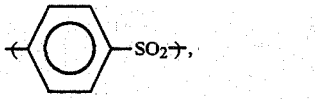

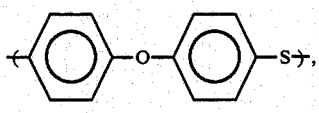

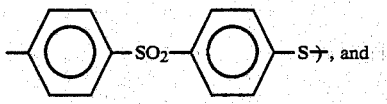

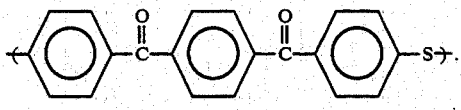

The polyarylene sulfide resin may preferably have a melt viscosity of 1–200 Pa.S (10–2000 poise), more preferably 2–120 Pa.S (20–1200 poise), further preferably 2.5–100 Pa.S (25–1000 poise), as measured at a temperature of 310° C. and a shear rate of $10^3$/sec.

The magnetic composition of the present invention comprises the above Ni-Zn-Cu-based ferrite in an amount of 70–95 wt. parts, preferably 75–93 wt. parts, and the polyarylene sulfide in an amount of 5–30 wt. parts, preferably 7–25 wt. parts, providing a total of 100 wt. parts together with the Ni-Zn-Cu-based ferrite. If the ferrite powder is less than 70 wt. parts, the permeability is lowered. In excess of 95 wt. parts, the composition becomes fragile.

The magnetic composition of the present invention can further contain 0–25 wt. % of a thermoplastic resin other than the polyarylene sulfide resin, such as polyamide resin, polyphenylene ether resin, polyether ether ketone, polyether ketone, polycarbonate or polystyrene, or a thermosetting resin, such as epoxy resin or a cured product thereof.

The magnetic composition according to the present invention can further contain an inorganic filler or fibrous reinforcing material, such as glass fiber, potassium titanate, silicon carbide, ceramic fiber, silicon nitride or asbestos, or an organic fibrous reinforcing material, such as aramide fiber.

It is particularly preferable to add epoxidized silicone oil into the composition of the present invention so as to improve the adhesiveness to a coil or a terminal electrode. By the addition, it is possible to suppress a separation from such a coil or terminal electrode or occurrence of a crack in the molded product even when subjected to a thermal impact, e.g., by re-flowing soldering. The epoxidized silicone oil may preferably be added in an amount of 0.1–5 wt. %, more preferably 0.2–2 wt. %.

The epoxidized silicone oil per se has been known as disclosed in Japanese Laid-Open Patent Application (JP-A)61-273733, JP-A 62-89768, and a technical brochure entitled "Silicone and Its Application" published from Toshiba Silicone K. K. (1988). More specifically, the epoxidized silicone oil may be defined as a silicone oil modified by replacing an organic group connected to an Si-group of the silicone oil with an epoxy group-containing organic group. The epoxidized silicone oil may preferably have an epoxy equivalent of 350–1000 g/equivalent, more preferably 400–700 g/equivalent. The epoxy equivalent of an epoxidized silicone oil sample may be measured by adding tetrahydrofuran and hydrochloric acid to have the hydrochloric acid react with the epoxy group in the sample and titrating the remaining non-reacted hydrochloric acid with an alkali.

So as to retain the basic properties of the permeable magnetic composition according to the present invention, it is preferred that the total amount of the Ni-Zn-Cu ferrite powder and the polyarylene sulfide resin occupies at least 85 wt. %, more preferably at least 95 wt. %, further preferably at least 97 wt. % of the composition.

The molding or shaping method applicable to the composition is not particularly limited but may preferably be one of applying a high pressure, such as injection molding or compression molding. For example, the injection molding may preferably be performed while applying a pressure of 400–3000 kgf/cm$^2$ more preferably 500–2000 kgf/cm$^2$ at a temperature which may be 15°–100° C. higher than the melting point of the polyarylene sulfide resin.

The permeable magnetic composition according to the present invention may suitably be used for production of, e.g., magnetic components, suitable for use as or use in coil and core, inductor, rotary transformer, EMI filter, and balun requiring a high permeability and electrical insulation.

EXAMPLES

Evaluation of compositions prepared in Examples and Comparative Examples was performed in the following manner.

Preparation of test piece

A pellet-form composition in each Example was supplied to an injection molding machine ("PS-10E", available from Nissei Jushi K. K.) to form a toroidal core having an outer diameter of 36 mm, an inner diameter of 24 mm and a thickness of 10 mm by injection molding under the conditions of a cylinder temperature of 340° C., a nozzle temperature of 340° C., an injection pressure of 1500 kgf/cm$^2$ and a mold temperature of 160° C.

Measurement of permeability

A polyester-coated copper wire of 0.3 mm in diameter was wound about the toroidal core in 165 turns, and the inductance was measured at 100 KHz by using an impedance analyzer ("HP4192A", available from Yokogawa Hewlett-Packard K. K.). From the impedance, the permeability $\mu$ was calculated by the following equation:

$$\mu=(L\times l_l\times 10^7)/(4\pi n^2 S),$$

wherein L denotes the inductance, $l_l$ denotes a magnetic path length, n denotes the number of coil turns (=165), and S denotes a core diameter. The length $l_l$ is calculated by the following equation:

$$l_l=(l_d-l_s)/\log(l_d/l_s)\times\pi,$$

wherein $l_d$ denotes the core outer diameter and $l_s$ denotes the core inner diameter.

Example 1

13.5 kg of Ni-Zn-Cu-based ferrite powder (calcined at 1100° C., Dav. (average particle size) 11 $\mu$m) having a composition represented by the chemical formula $Ni_{0.19}Zn_{0.63}Cu_{0.18}Fe_2O_{4.00}$ and 1.5 kg of linear phenyl sulfide homopolymer (melt viscosity: about 20 Pa.s (200 poise), melting point: 290° C.) were blended in a 20 liter-Henschel mixer and melt-kneaded through a twin-screw kneading extruder to prepare a composition in the form of pellets. A toroidal core was molded from the composition and the permeability thereof was measured in the above-described manner, whereby a value of 14.8 H/m was obtained.

The outline of the composition and the permeability of the molded product as well as the calcination temperature and the permeability of the magnetic powder (and also the sintering temperature for providing the permeability measurement sample) are summarized in the following Table 1 together with those of other Examples and Comparative Examples which will be described hereinafter. The calcination period was 2 hours in all Examples and Comparative Examples.

TABLE 1

| | Magnetic composition | | | | | | | Magnetic powder | | |
|---|---|---|---|---|---|---|---|---|---|---|
| | $Ni_aZn_bCu_cFe_2O_d$ | | | | | | Permeability H/m | Calcination temp (°C.) | Sintering temp (°C.) | Permeability H/m |
| | a | b | c | d | Content (%) | Dav.* (um) | | | | |
| Ex. 1 | 0.19 | 0.63 | 0.18 | 4.00 | 90 | 11 | 14.8 | 1100 | 1200 | 435 |
| Ex. 2 | 0.20 | 0.58 | 0.22 | 4.01 | 90 | 10 | 15.7 | 1100 | 1200 | 512 |
| Ex. 2A | 0.20 | 0.58 | 0.22 | 4.01 | 90 | 10 | 15.8 | 1300 | 1350 | 502 |
| Ex. 3 | 0.63 | 0.31 | 0.15 | 4.09 | 90 | 12 | 11.7 | 1100 | 1200 | 102 |
| Ex. 4 | 0.27 | 0.67 | 0.16 | 4.10 | 90 | 9 | 13.3 | 1100 | 1200 | 490 |
| Ex. 6 | 0.20 | 0.58 | 0.22 | 4.01 | 85 | 10 | 10.2 | 1100 | 1200 | 512 |
| Comp. | | | | | | | | | | |
| Ex. 1 | 0.36 | 0.62 | 0 | 3.98 | 90 | 3 | 11.0 | 1300 | 1350 | 734 |
| Ex. 2 | 0.60 | 0.37 | 0 | 3.97 | 90 | 10 | 10.8 | 1300 | 1350 | 152 |
| Ex. 2A | 0.60 | 0.37 | 0 | 3.97 | 90 | 10 | 10.7 | 1100 | 1200 | 136 |
| Ex. 3 | 0.30 | 0.30 | 0.41 | 4.01 | 90 | 11 | 10.5 | 1050 | 1100 | 66 |

*Dav. = average particle size

Example 2

A composition was prepared from 13.5 kg of Ni-Zn-Cu-based ferrite powder represented by the formula $Ni_{0.20}Zn_{0.58}Cu_{0.22}Fe_2O_{4.01}$ (calcined at 1100° C.) and 1.5 kg of the linear phenylene sulfide homopolymer and formed into a toroidal core in the same manner as in Example 1. The core provided a permeability shown in Table 1.

Example 2A

Example 2 was repeated except that the Ni-Zn-Cu-based ferrite was replaced by one of the same compositions but calcined at 1300° C.

Example 3

A composition was prepared from 13.5 kg of Ni-Zn-Cu-based ferrite powder represented by the formula $Ni_{0.63}Zn_{0.31}Cu_{0.15}Fe_2O_{4.09}$ (calcined at 1100° C.) and 1.5 kg of the linear phenylene sulfide homopolymer and formed into a toroidal core in the same manner as in Example 1. The core provided a permeability shown in Table 1.

Example 4

A composition was prepared from 13.5 kg of Ni-Zn-Cu-based ferrite powder represented by the formula $Ni_{0.27}Zn_{0.67}Cu_{0.16}Fe_2O_{4.10}$ (calcined at 1100° C.) and 1.5 kg of the linear phenylene sulfide homopolymer and formed into a toroidal core in the same manner as in Example 1. The core provided a permeability shown in Table 1.

Example 5

Figure 2:
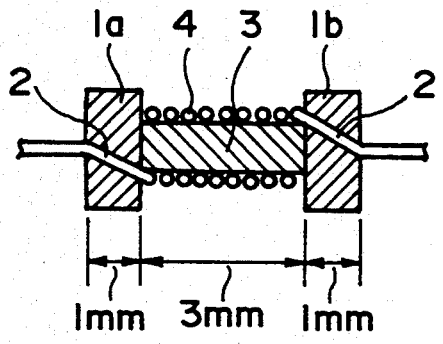

A chip-form ferrite core for an inductor having a shape as shown in FIG. 1 (perspective view) and FIG. 2 (sectional view) was provided, The core had two end disks 1 each having a diameter of 3 mm and a thickness of 1 mm and a through hole 2 to pass a lead wire therethrough, The disks 1 were connected with a cylindrical bar 3 having a length of 3 mm and a diameter of 1.8 mm, A copper wire was wound in the form of a coil 4 about the bar 3 and the two ends thereof were passed through the disks 1 to form leads 4*a* and 4*b*.

The coil and core were placed in a mold as an insert and encapsulated except for the leads 4*a* and 4*b* with the composition of the above Example 1 to form a molded product in the form of a rectangular parallelepiped measuring 7 mm×4 mm×4 mm by using an injection molding machine ("JT-40", available from Nippon Seiko-sho K. K.). The molded product was immersed for 10 seconds in a solder bath at 260° C. and then taken out for inspection of the appearance. As a result, no crack was observed at the parts contacting the leads of the molded product, and no surface abnormality was observed either. Further, no change in inductance was observed before and after the immersion in the solder bath.

Example 6

12.75 kg of Ni-Zn-Cu-based ferrite represented by the chemical formula $Ni_{0.20}Zn_{0.58}Cu_{0.22}Fe_2O_{4.01}$ (calcined at 1100° C.) and 2.25 kg of the polyphenylene sulfide resin were blended in a 20 liter-Henschel mixer, and 112.5 g of epoxidized silicone oil was added and mixed therewith. The resultant mixture was melt-kneaded through a twin-screw kneading extruder to prepare a composition in the form of pellets, which was then molded into a toroidal core in the above-described manner. The core provided a permeability shown in Table 1 above.

A coil and a core identical to those used in Example 5 were encapsulated with the composition of this Example in a similar manner as in Example 5 to form a similar molded product. The molded product was immersed for 10 seconds in a solder bath at 260° C. and then taken out for inspection of the appearance. As a result, no crack was observed at the parts contacting the leads of the molded product, and no surface abnormality was observed either. Further, no change in inductance was observed before and after the immersion in the solder bath.

Comparative Example 1

A composition was prepared from 13.5 kg of Ni-Zn-based ferrite powder represented by the formula $Ni_{0.36}Zn_{0.62}Fe_2O_{3.98}$ (calcined at 1300° C.) and 1.5 kg of the linear phenylene sulfide homopolymer and formed into a toroidal core in the same manner as in Example 1. The core provided a permeability shown in Table 1.

Comparative Example 2

A composition was prepared from 13.5 kg of Ni-Zn-based ferrite powder represented by the formula $Ni_{0.60}Zn_{0.37}Fe_2O_{3.97}$ (calcined at 1300° C.) and 1.5 kg of the linear phenylene sulfide homopolymer and formed into a toroidal core in the same manner as in Example 1. The core provided a permeability shown in Table 1.

Comparative Example 2A

Comparative Example 2 was repeated except that the Ni-Zn-based ferrite was replaced by one of the same compositions but calcined at 1100° C.

Comparative Example 3

A composition was prepared from 13.5 kg of Ni-Zn-Cu-based ferrite powder represented by the formula $Ni_{0.30}Zn_{0.3}Cu_{0.41}Fe_2O_{4.01}$ (calcined at 1050° C.) and 1.5 kg of the linear phenylene sulfide homopolymer and formed into a toroidal core in the same manner as in Example 1. The core provided a permeability shown in Table 1.

As described above, according to the present invention, there is provided a polyarylene sulfide resin composition showing a high permeability.

From the composition, it is possible to obtain magnetic components suitable for use as or use in coil-core, inductor, rotary transformer, EMI filter and balun. These components or articles can be suitably used when they are required to show excellent heat-resistance and chemical resistance.

What is claimed is:

1. A permeable magnetic composition, comprising 5–30 wt. parts of polyarylene sulfide resin and 70–95 wt. parts of Ni-Zn-Cu-based ferrite powder providing a total of 100 wt. parts together with the polyarylene sulfide resin, said Ni-Zn-Cu-based ferrite having a composition represented by the following formula (1):

$$Ni_aZn_bCu_cFe_2O_d,$$

wherein a, b, c and d are numbers satisfying $0.10 \leqq a \leqq 0.70$, $0.10 \leqq b \leqq 0.80$, $0.10 \leqq c \leqq 0.35$ and $3.97 \leqq d \leqq 4.20$.

2. A composition according to claim 1, wherein the numbers a–d satisfy $0.15 \leqq a \leqq 0.50$, $0.40 \leqq b \leqq 0.75$, $0.15 \leqq c \leqq 0.30$, and $3.98 \leqq d \leqq 4.15$.

3. A composition according to claim 1, comprising 7–25 wt. parts of the polyarylene sulfide resin and 75–93 wt. parts of the Ni-Zn-Cu-ferrite powder.

4. A composition according to claim 1, further containing 0.1–5 wt. % of epoxidized silicone oil.

5. A magnetic component, comprising a molded product of a permeable magnetic composition according to claim 1.

6. A magnetic component, comprising a molded product of a permeable magnetic composition according to claim 2.

7. A magnetic component, comprising a molded product of a permeable magnetic composition according to claim 3.

8. A magnetic component, comprising a molded product of a permeable magnetic composition according to claim 4.

9. A composition according to claim 1, wherein said Ni-Zn-Cu-based ferrite powder has a permeability which is at least 80% of the saturation permeability of the Ni-Zn-Cu-based ferrite.

10. A magnetic component, comprising molded product of a permeable magnetic composition according to claim 9.

* * * * *

UNITED STATES PATENT AND TRADEMARK OFFICE

CERTIFICATE OF CORRECTION

PATENT NO. : 5,435,929

DATED : July 25, 1995

INVENTOR(S) : MASAHITO TADA and KEIICHIRO SUZUKI

It is certified that error appears in the above-indentified patent and that said Letters Patent is hereby corrected as shown below:

On the cover page, in the lefthand column, under the heading "[75] Inventors:" correct the spelling of "Masahito".

Signed and Sealed this

Twelfth Day of December, 1995

*Attest:*

*Attesting Officer*

Bruce Lehman

BRUCE LEHMAN

*Commissioner of Patents and Trademarks*